US005308131A

United States Patent [19]

Galindo et al.

[11] Patent Number: 5,308,131

[45] Date of Patent: May 3, 1994

[54] INTERCHANGEABLE FACEPLATES FOR DOOR LATCHES PERMITTING ADAPTATION TO A VARIETY OF STANDARD DOOR PREPARATIONS

[75] Inventors: Jaime Galindo, Hayward; Ralph Neary, San Francisco, both of Calif.

[73] Assignee: Schlage Lock Company, San Francisco, Calif.

[21] Appl. No.: 37,748

[22] Filed: Mar. 26, 1993

[51] Int. Cl.[5] ..... E05C 1/16

[52] U.S. Cl. ..... 292/337; 292/DIG. 38

[58] Field of Search ..... 292/337, 169 R, 169.13, 292/169.17, DIG. 61, 169.19

[56] References Cited

U.S. PATENT DOCUMENTS 4,736,973 4/1988 Fang ..... 292/337

5,094,488 3/1992 Boadwine et al. ..... 292/337

*Primary Examiner*—Richard E. Moore

*Attorney, Agent, or Firm*—Robert F. Palermo

[57] ABSTRACT

A door latch has a housing for installation in a prepared cavity at a door edge and has interchangeable faceplates for finishing the door edge. The interchangeable faceplates each have an opening for permitting extension and retraction of a latch bolt, have a peripheral shape required for compatibility with the prepared cavity, and have features providing for releasably securing the faceplates to the housing and to the door edge. This permits installation of door latches regardless of the door preparation by merely interchanging the faceplates to match the door preparation.

1 Claim, 3 Drawing Sheets

INTERCHANGEABLE FACEPLATES FOR DOOR LATCHES PERMITTING ADAPTATION TO A VARIETY OF STANDARD DOOR PREPARATIONS

BACKGROUND OF THE INVENTION

This invention relates generally to door latches and more particularly to faceplates for door latches which are interchangeable and may be used to adapt a standard door latch to a variety of common door preparations.

A high percentage of doors are made today with factory prepared cavities already formed at or near the door edge. This allows rapid and easy installation, by relatively unskilled workers, of such doors in buildings during construction or remodeling.

Commonly used latches, however, may have one of a variety of faceplates more or less permanently attached to the latch housing by staking or resistance welding. Therefore, it is necessary to have on hand latches with faceplates compatible with any one of a number of prepared door latch cavities; for example, sharp cornered mortise, round cornered mortise, and circular. Of course, slight size differences may be available in all latch types.

In order to accommodate the variety of possible door preparations without maintaining a stock of latches three or more times as large as required by the project, it is necessary to determine the type of door preparation before procuring the latches. This may delay completion while waiting to obtain the correct latches. Changing faceplates, to adapt the latches to door preparations, damages welded or staked faceplates during removal and requires complex and costly tooling. In any case, the cost of the project increases and completion is delayed.

The foregoing illustrates limitations known to exist in present door latches and methods for adaptation of such latches to a variety of door cavity preparations. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing, for use with a conventional style door latch mounted in its housing in a door edge, an interchangeable faceplate having an opening for permitting extension and retraction of a latch bolt, having a peripheral shape required for compatibility with a prepared door cavity, and having provisions for releasably securing the faceplate to the housing and to the door edge.

The foregoing and other aspects will become apparent from the following detailed description of the invention when considered in conjunction with the accompanying drawing figures.

BRIEF DESCRIPTION OF THE DRAWING FIGURES

Figure 5:
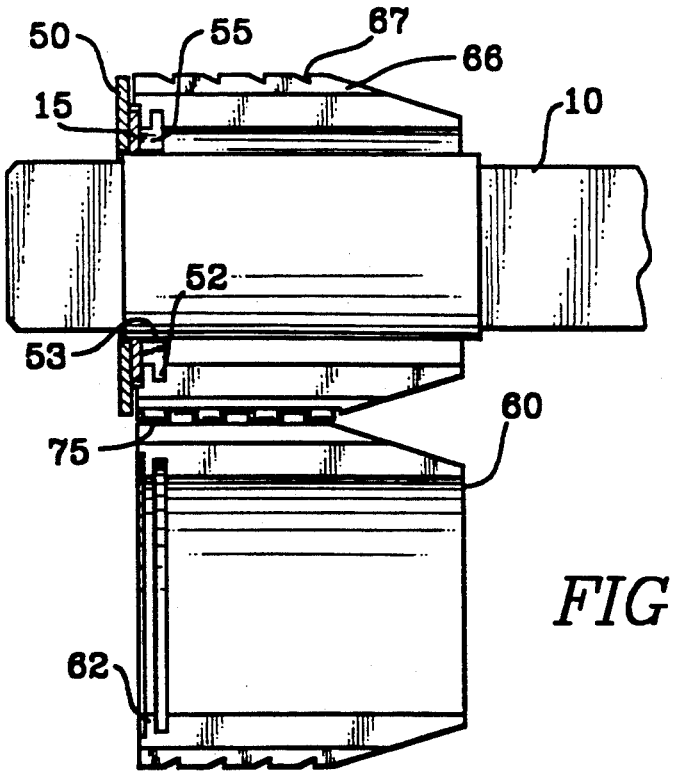
Figure 2:
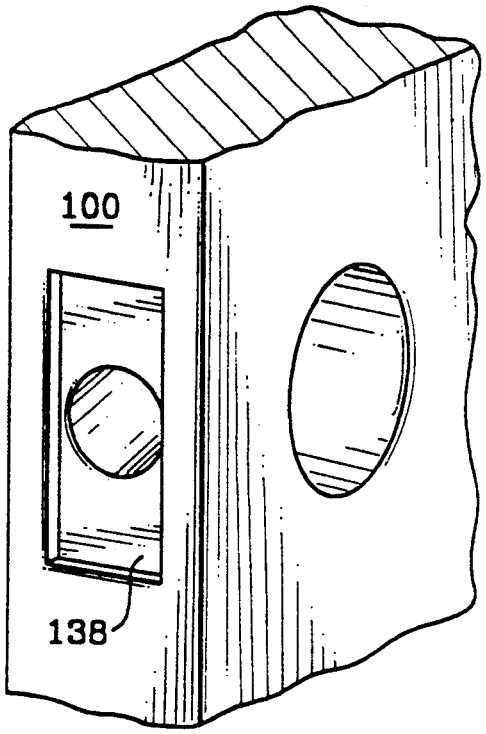
FIG. 2 is a fragmentary view of a door edge showing a shape-cornered mortise cavity.
Figure 2A:
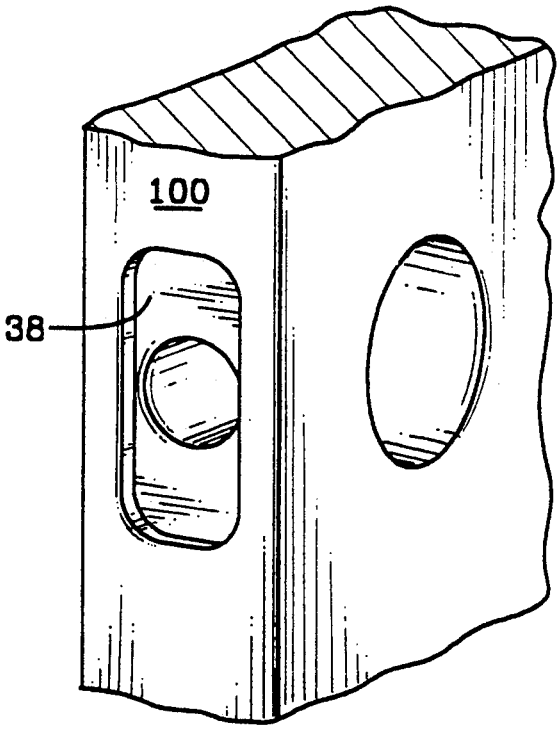
Figure 3:
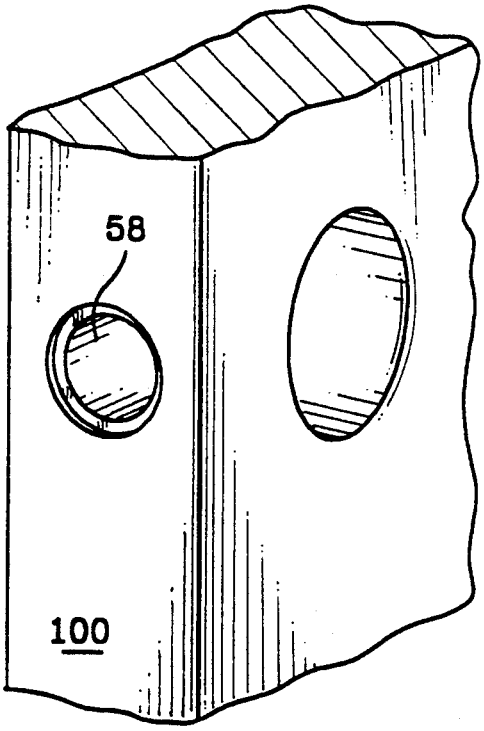
Figure 4:
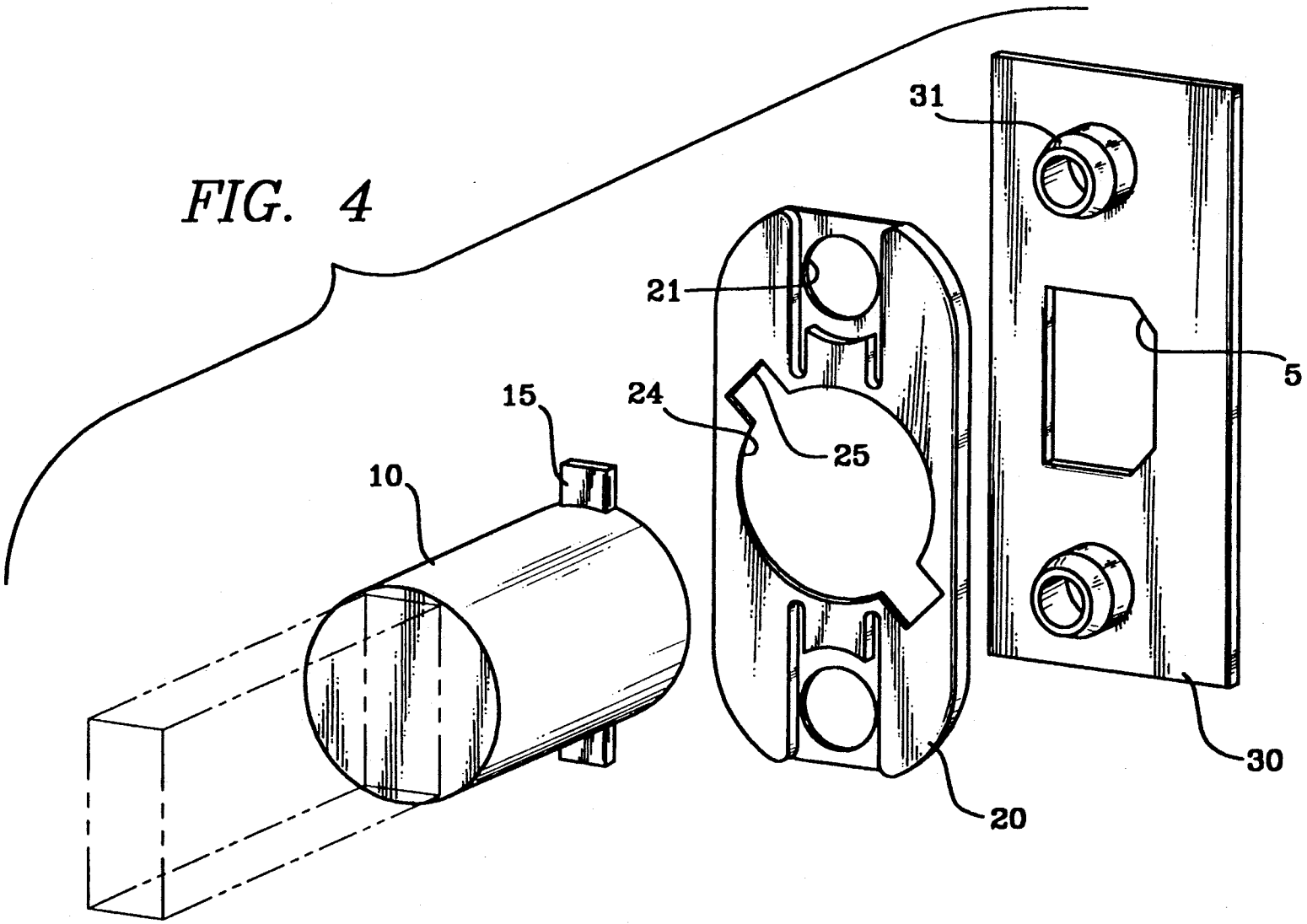

FIG. 2*a* is a view as in FIG. 2 showing a round-cornered mortise cavity;

FIG. 3 is a view as in 2 and 2*a*, this time showing a round bored cavity;

FIG. 4 is a rear quarter view showing one embodiment of the present invention; and FIG. 5 is a rear quarter view showing another embodiment of the invention.

DETAILED DESCRIPTION

Figure 1:
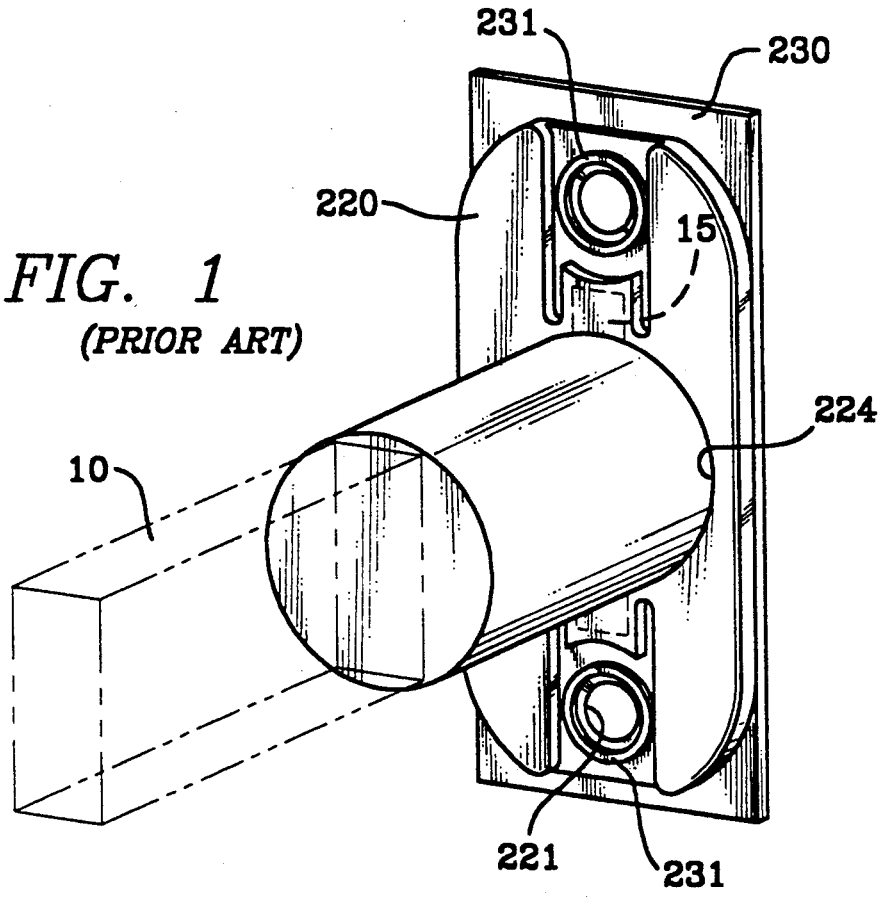
FIG. 1 (PRIOR ART)
FIG. 1 is a schematic rear quarter view illustrating a standard design door latch having a faceplate more or less permanently attached.

A standard door latch, as shown in FIG. 1, usually consists of a bolt 10 (latch bolt assembly) attached to a faceplate 230 by means of a backplate 220. The bolt 10 is inserted through opening 224 in backplate 220 until it rests against tabs 15 of the bolt housing. Faceplate 230 has pins 231 which extend through holes 221 of backplate 220 and are staked or otherwise processed to more or less permanently attach them so that the tabs 15 of bolt 10 are captured between the faceplate and the backplate. Pins 231 also have countersunk screw holes through which screws are installed to secure the faceplate to the door edge. Securing the faceplate also secures the latch bolt assembly to the door edge. As previously described, this construction makes it very difficult, at best, to change faceplates in latch bolt assembly/faceplate combinations of the prior art.

FIGS. 2, 2*a*, and 3 show door edge preparations featuring sharp-cornered rectangular mortise, round-cornered rectangular mortise, and round bored cavities 38, 138, and 58, respectively in door edge 100. For the sake of illustration, the bored hole for the bolt 10 is shown as being cylindrical, but it could as well be of rectangular cross-section in some cases. Note that the sharp-cornered and round-cornered rectangular mortises are of equal and standard depth.

FIG. 4 is a rear perspective view showing the faceplate embodiment for the rectangular mortise door edge preparation. Here, only the sharp-cornered plate is illustrated, but it should be understood that the assembly is identical to that of the round-cornered embodiment. Bolt 10 has tabs 15 protruding radially from its housing. Faceplate 30 (130 if round-cornered) has a latch bolt hole 5 and protruding bosses 31 which, like the pins 231 of previously described faceplate 230 of the prior art, also have countersunk screw holes for securing the bolt/faceplate combination to the door edge. When paired with backplate 20, bosses 31 of faceplate 30 are a press fit in fastener holes 21 of backplate 20. Backplate 20 also has a latch housing opening 24 and tab slots 25.

Faceplate 30 and backplate 20 are joined by inserting bosses 31 into holes 21 and lightly pressing the faceplate 30 and backplate 20 together. Bolt 10 is inserted though opening 24, while keeping tabs 15 aligned with slots 25, twisting the bolt relative to the backplate to properly align the tabs between the faceplate an the backplate, and tightly pressing the plates together. There is a slight local gap between faceplate 30 (or 130) and backplate 20 to accommodate tabs 15 when the assembly is tightly pressed. For disassembly, the backplate is pried slightly away from the faceplate so the tabs are free to move, and then the bolt is twisted outer-clockwise in the backplate to remove the bolt once the tabs and slots are aligned. The combination of bolt and faceplate is secured to the door edge by screws through the holes in bosses 31.

For round bored preparation, circular faceplates are preferred. Using the same bolt 10 shown in FIG. 5, a circular faceplate 50 which has a bolt opening 5 is provided for use with round bored door preparations. Slots 55 receive tabs 15 to permit insertion of the bolt housing into bore 53 of faceplate 50. When fully inserted, tabs 15 rest between the rear surface of the face ring 51 and the front face of retention ring 52. Sleeve 60 is installed over the bolt 10 such that lip 62 lies between ring 52 and tabs 15. This locks faceplate 50 to bolt 10. Sleeve 60 is made in two or more segments which may be separate or may be joined by a hinge 75 or other connecting provision. On the outer surface of sleeve 60 are longitudinal ribs 66 which are beveled to permit easy starting into the round bored door preparation after proper assembly and alignment. When pressed or driven into the door, the sleeve is securely locked to the faceplate 50 and the bolt 10 as described, and the orientation of the bolt is fixed by the pressure of ribs 66 against the bore. Ribs 66 may also be provided with barbs 67 to increase the longitudinal grip of the sleeve in the door preparation. This enhances the strength of the installation without resorting to screws or other separate fasteners.

It is clear that the circular faceplate of FIG. 5 could as well be a rectangular faceplate with round or square corners and having bore 53, slots 55, retention ring 52, and bolt opening 5. The lip 62 of sleeve 60 will mesh as well with retention ring 52, regardless of the shape of the faceplate. In other words, the sleeve type attachment scheme may be applied to any shape of faceplate. Of course, sleeve 60 may be of two or more pieces connected by hinges, or separate, or otherwise joined.

With any of the faceplates described, the mounting of the knob and shaft also serve to secure the latch bolt/-faceplate combination to the door. Thus, even with the convenience of interchangeability, the faceplates of the present invention do not compromise the strength of the installation.

We claim:

1. In a door latch of the type having a housing with one or more protrusions thereon, which is to be installed in a prepared cavity at a door edge and which requires a faceplate for finishing the door edge, the improvement, in combination with said door latch, comprising;

an interchangeable faceplate having an opening for permitting extensions and retraction for a latch bolt, having a peripheral shape required for compatibility with the prepared cavity, and having one or more recesses in said faceplate for receiving said one or more protrusions on said housing;

means releasably attached to said faceplate, for capturing said protrusions on said housing in engagement with said recesses in said faceplate, said means comprising a sleeve having a lip for engaging a retention ring on said faceplate, said sleeve being split longitudinally into two or more segments and having a beveled outer surface facilitating driving or pressing said sleeve into a prepared cavity in a door edge when assembled on said faceplate and said housing; and means for securing said faceplate and said housing to said door edge.

* * * * *